US007093868B1

(12) United States Patent
Shen

(10) Patent No.: US 7,093,868 B1
(45) Date of Patent: Aug. 22, 2006

(54) TELESCOPIC CHOPSTICK SET

(75) Inventor: Shun Tsung Shen, Nuan-Tou (TW)

(73) Assignee: Jing Si Publications Co., Ltd., Taipei (TW)

( * ) Notice: Subject to any disclaimer, the term of this patent is extended or adjusted under 35 U.S.C. 154(b) by 0 days.

(21) Appl. No.: 11/296,211

(22) Filed: Dec. 8, 2005

(30) Foreign Application Priority Data

Mar. 25, 2005 (TW) ..... 94204711 U

(51) Int. Cl.
*A47G 21/00* (2006.01)

(52) U.S. Cl. ..... 294/1.1; 294/5.5

(58) Field of Classification Search ..... 294/1.1, 294/5.5, 7, 99.2; 30/322–324, 326, 340
See application file for complete search history.

(56) References Cited

U.S. PATENT DOCUMENTS 4,707,922 A * 11/1987 Hosak-Robb ..... 30/322
5,431,465 A * 7/1995 Shibata ..... 294/1.1
D368,413 S * 4/1996 Lowenfels ..... D7/653
5,810,411 A * 9/1998 Major ..... 294/99.2
6,328,360 B1 * 12/2001 Freeman ..... 294/1.1

* cited by examiner

*Primary Examiner*—Dean J. Kramer
(74) *Attorney, Agent, or Firm*—Rosenberg, Klein & Lee

(57) ABSTRACT

A telescopic chopstick set including pair of chopsticks and a jacket for receiving the chopsticks. Each chopstick has an upper half and a lower half extendably nested in the upper half. An upper end of the upper half has an upper opening, while a lower end of the upper half has a lower opening. The lower half can be fitted into the upper half from the upper opening. A press member is fitted in the upper opening of the upper half. A pair of opposite first protuberances and a pair of opposite second protuberances are formed on inner wall face of the upper half near the upper opening. When the lower half is retracted into the upper half, the first protuberances abut against the lower half. The second protuberances serve to engage with and fix the press member with the upper half. A clip is disposed on outer side of upper section of the jacket for easy carriage of the telescopic chopstick set.

3 Claims, 7 Drawing Sheets

TELESCOPIC CHOPSTICK SET

BACKGROUND OF THE INVENTION

The present invention is related to a telescopic chopstick set which can be telescoped and shortened after used. Therefore, the telescopic chopstick set is conveniently portable and meets the hygienic requirements.

A conventional chopstick is an elongated rod body. The length of the chopstick cannot be shortened so that it is inconvenient to carry the chopsticks. FIG. 7 shows a conventional telescopic chopstick which is divided into a front section 51 and a handle section 52. The front section 51 can be retracted into the handle section 52. In use, the front section 51 is extended out of the handle section 52 and screwed and fixed with the handle section 52. Such chopstick can be shortened. However, when the front section 51 is nested in the handle section 52, the front section 51 is not firmly fixed therein. Therefore, the front section 51 tends to extend out of the handle section 52 to be exposed to outer side. Accordingly, the front section 51 is apt to be contaminated.

FIG. 8 shows another conventional telescopic chopstick 6 which is composed of multiple segments and can be telescoped. The segments are connected with each other by means of engaging ribs 61 and engaging grooves 62. A clip 63 is disposed at top end of the chopstick 6 for easy carriage. Such telescopic chopsticks 6 can be shortened and easily carried. However, the front end of the telescopic chopstick is still subject to contamination. Moreover, in the case that the chopsticks are placed in a pocket of a clothes, the clothes are apt to be stained and contaminated by oil.

SUMMARY OF THE INVENTION

It is therefore a primary object of the present invention to provide a telescopic chopstick set which can be telescoped and shortened after used. Therefore, the telescopic chopstick set is conveniently portable and meets the requirements for hygiene and environmental protection.

According to the above object, the telescopic chopstick set of the present invention includes a pair of chopsticks and a jacket for receiving the chopsticks. Each chopstick has an upper half and a lower half. The perimeters of two ends of the lower half are different from each other. An end of the lower half with a longer perimeter has a coupling section for fitting with a bottom end of the upper half. The upper half is a hollow member in which the lower half is accommodated. The upper end of the upper half has an upper opening. The lower end of the upper half has a lower opening. An end of the lower half with a shorter perimeter can be fitted into the upper opening of the upper half. An inner perimeter of the lower opening is shorter than the perimeter of the coupling section of the lower half, whereby the coupling section of the lower half can be tightly fitted in the bottom end of the upper half. A press member is fitted in the upper opening of the upper half. A pair of opposite first protuberances and a pair of opposite second protuberances are formed on inner wall face of the upper half near the upper opening. When the lower half is retracted into the upper half, the first protuberances abut against the coupling section of the lower half. The second protuberances serve to engage with and fix the press member with the upper half. A clip is disposed on outer side of upper section of the jacket for easy carriage of the telescopic chopstick set.

The present invention can be best understood through the following description and accompanying drawings wherein:

DETAILED DESCRIPTION OF THE PREFERRED EMBODIMENTS

Figure 1:
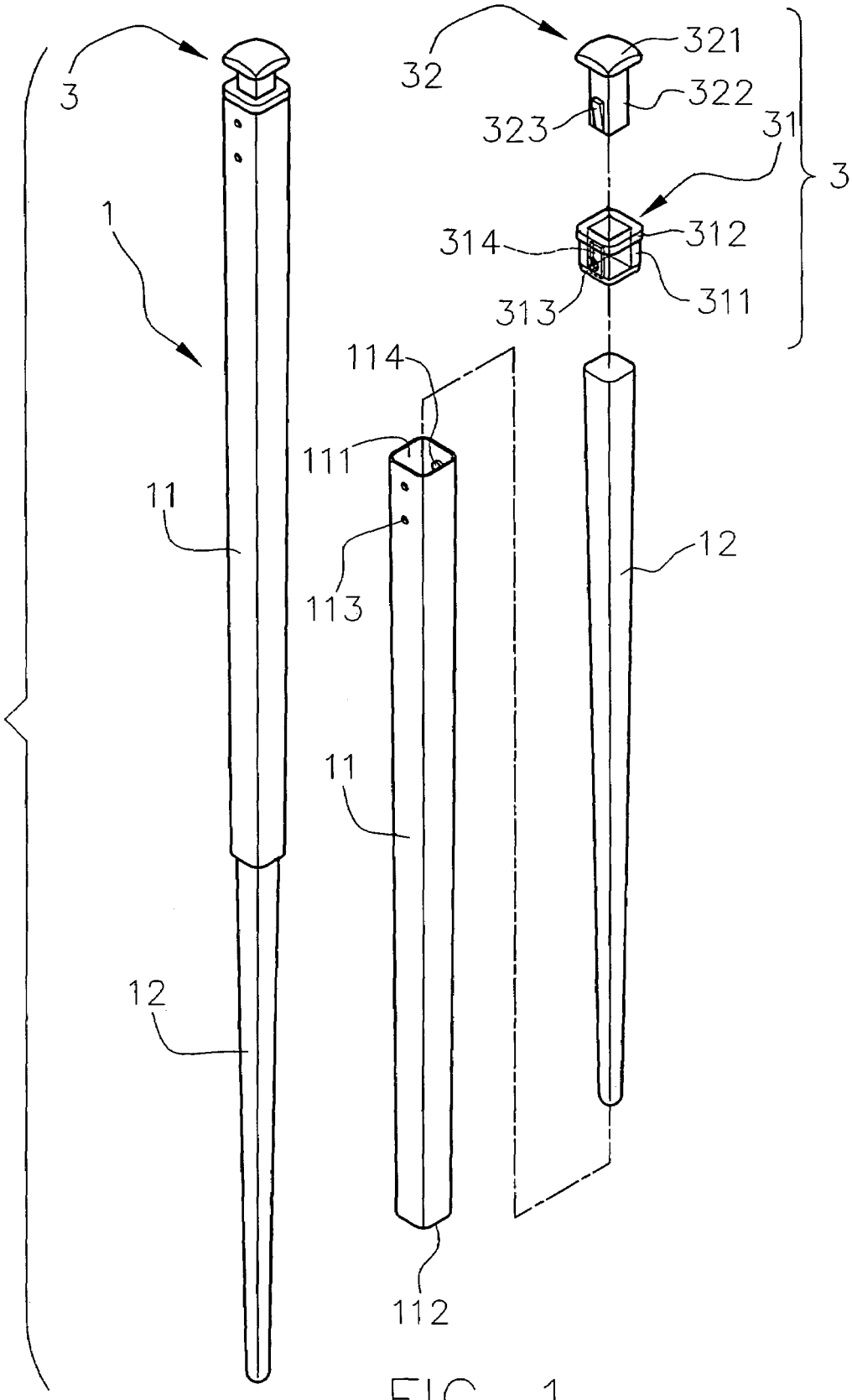
FIG. 1 is a perspective exploded view of the telescopic chopstick set of the present invention.
Figure 2:
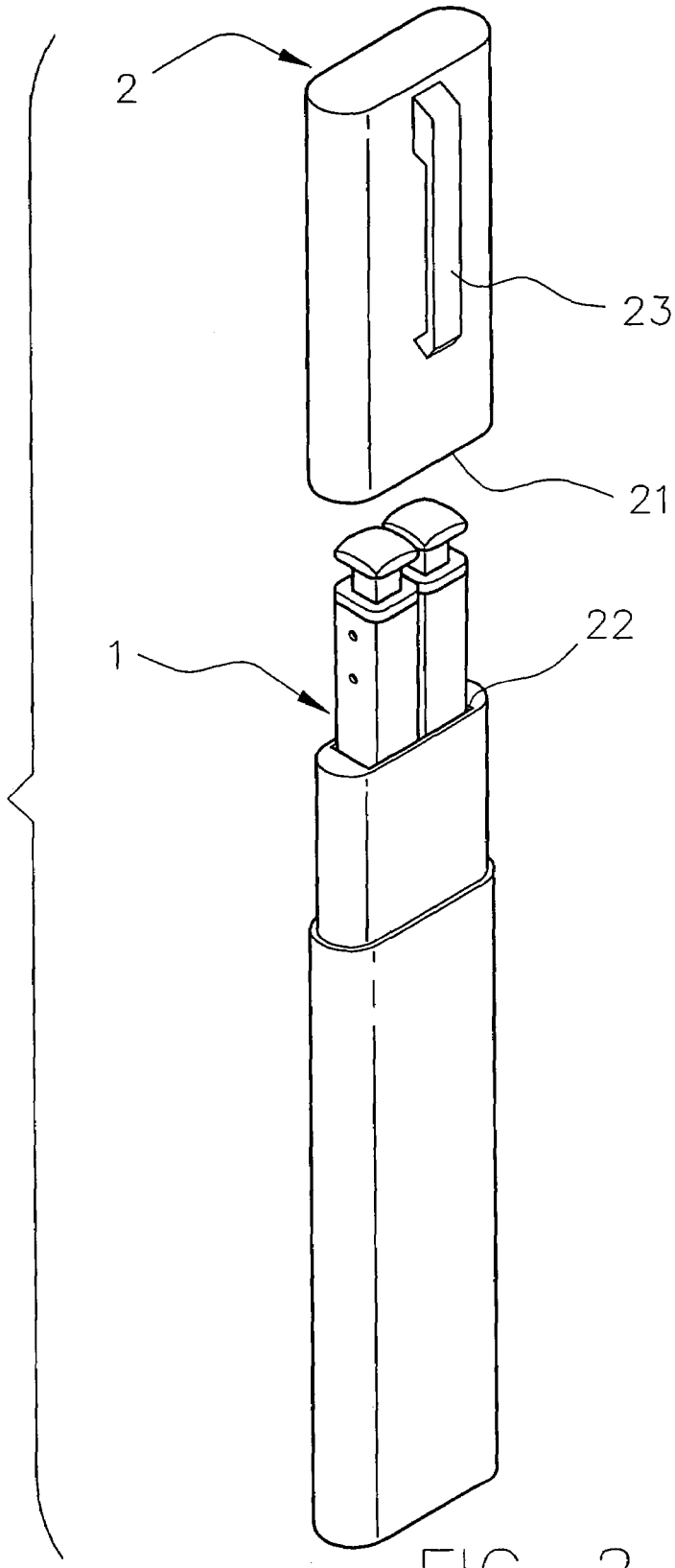
FIG. 2 is a perspective assembled view of the telescopic chopstick set of the present invention.

Please refer to FIG. 1. The telescopic chopstick set of the present invention includes a pair of chopsticks 1 and a jacket 2 for receiving the chopsticks 1. In this embodiment, the jacket 2 is a pen-like bar body having an upper receiving space 21 and a lower receiving space 22. A clip 23 is disposed on outer side of upper section of the bar body for easy carriage. Each chopstick 1 has an upper half 11 and a lower half 12. In this embodiment, the lower half 12 is a substantially rectangular solid rod body. The perimeters of two ends of the lower half 12 are different from each other. An end of the lower half 12 with a longer perimeter has a coupling section 121 for fitting with a bottom end of the upper half 11. The upper half 11 is a hollow member in which the lower half 12 is accommodated. The upper end of the upper half 11 has an upper opening 111, the lower end of the upper half 11 has a lower opening 112. An end of the lower half 12 with a shorter perimeter can be fitted into the upper opening 111. The inner perimeter of the lower opening 112 is shorter than the perimeter of the coupling section 121 of the lower half 12. Therefore, the coupling section 121 of the lower half 12 can be tightly fitted with the bottom end of the upper half 11. A press member 3 is fitted in the upper opening 111 of the upper half 11. In this embodiment, the press member 3 has a pocket 31 and a press button 32. The press button 32 has a press section 321 and a stem 322 extending from the press section 321. A stop section 323 is formed on the stem 322. The pocket 31 is fitted in the upper opening 111 and has a chucking section 311 and a fitting frame 312. The chucking section 311 has a pair of transverse locating holes 313 opposite to each other. A slide channel 314 is formed on inner wall face of the chucking section 311. The slide channel 314 has a lower opening. The stop section 323 of the stem 322 is slidably inlaid in the slide channel 314. A pair of opposite first protuberances 113 and a pair of opposite second protuberances 114 are formed on inner wall face of the upper half 11 near the upper opening. When the lower half 12 is retracted into the upper half 11, the first protuberances 113 abut against the coupling section 121 of the lower half 12. The second protuberances 114 are chucked in the locating holes 313 for fixing the press member 3 with the upper half 11. The chopsticks 1 can be placed into the jacket 2 to serve as a portable telescopic chopstick set as shown in FIG. 2.

Figure 3:
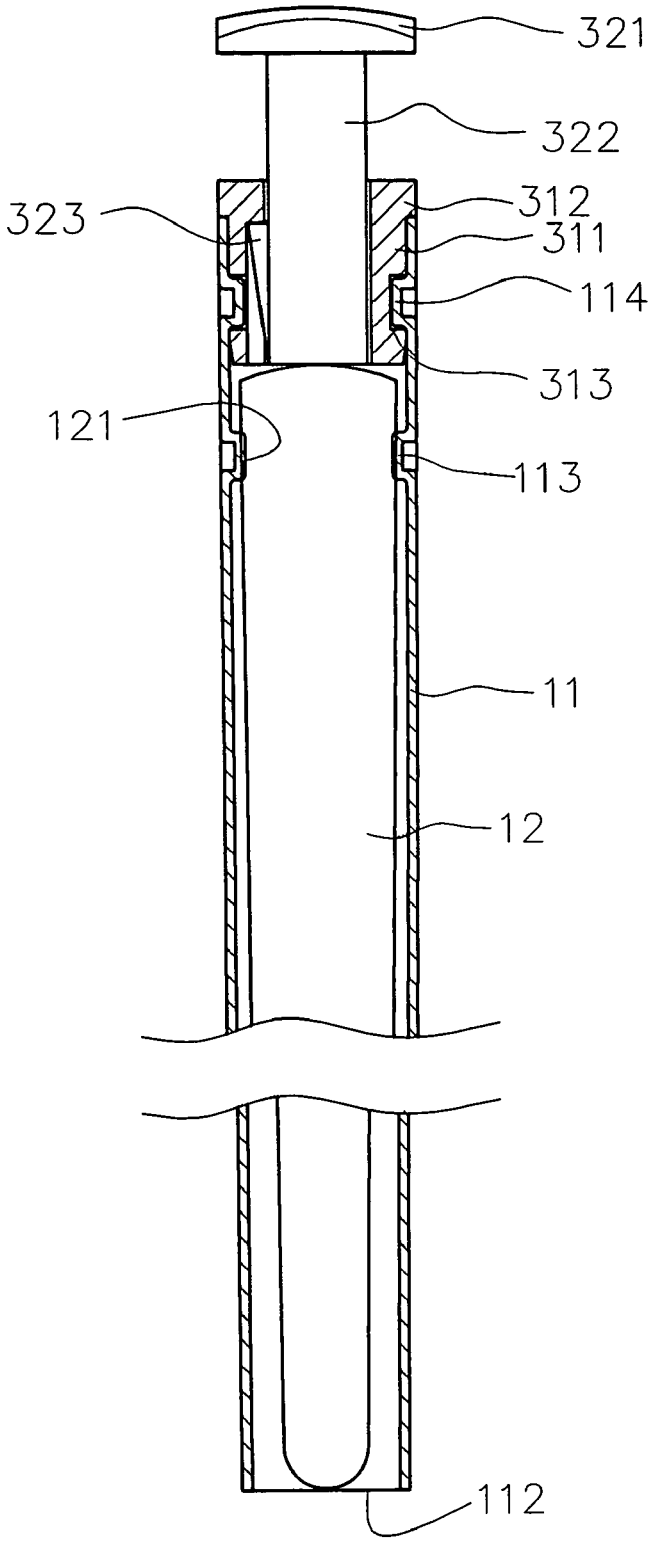
FIG. 3 is a sectional assembled view of the telescopic chopstick set of the present invention.

Referring to FIG. 3, the lower half 12 is nested into the upper half 11. In normal state, the lower half 12 of the chopstick 1 is accommodated in the upper half 11 with the first protuberances 113 abutting against the coupling section 121 of the lower half 12. Under such circumstance, the lower half 12 is prevented from detaching from the upper half 11 and the bottom end of the lower half 12 is totally hidden in the upper half 11 without being exposed to outer side and contaminated.

Figure 4:
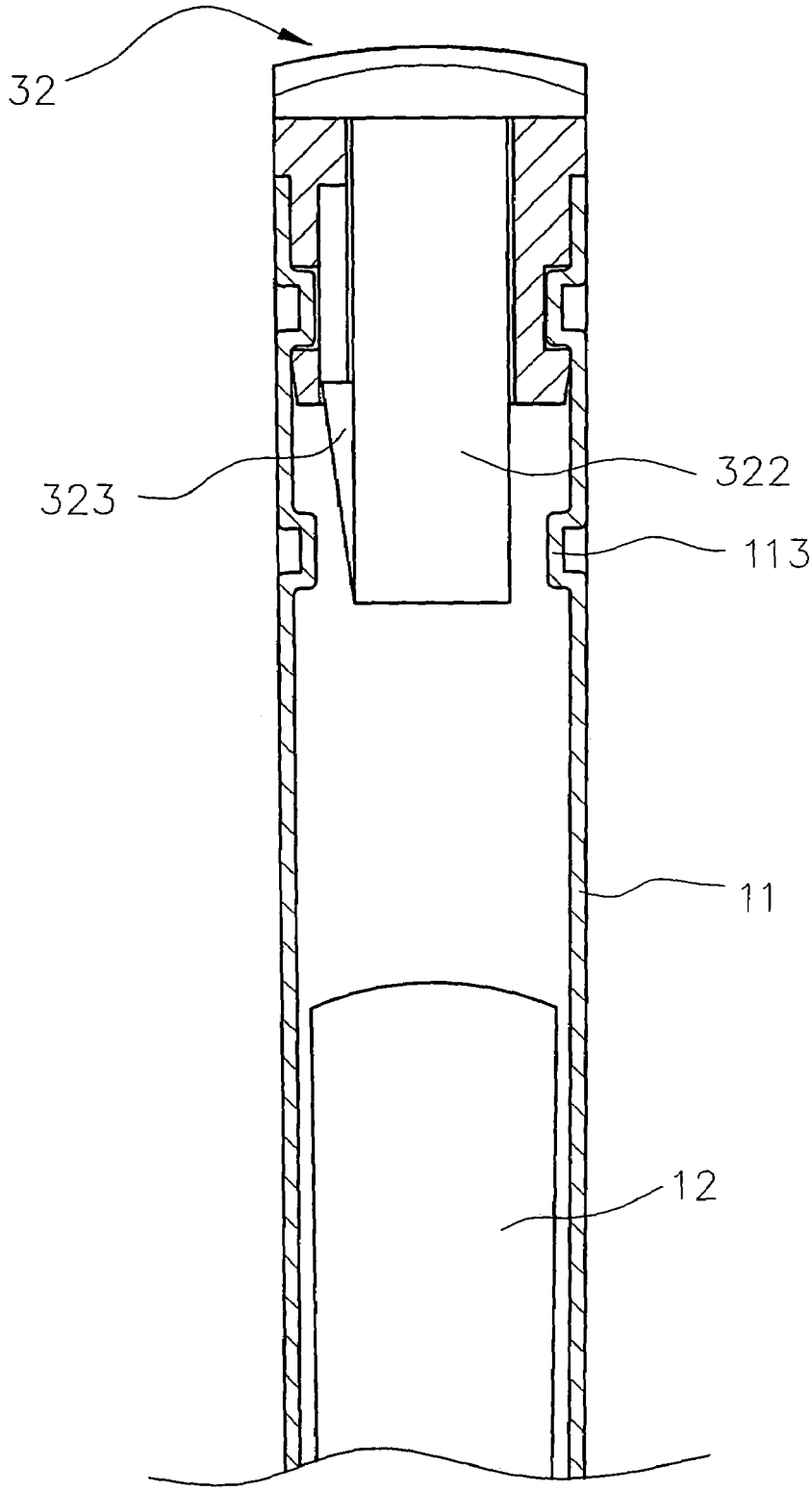
FIG. 4 is an enlarged view of the telescopic chopstick set of the present invention, showing that the lower half is disengaged from the upper half of the chopstick.
Figure 5:
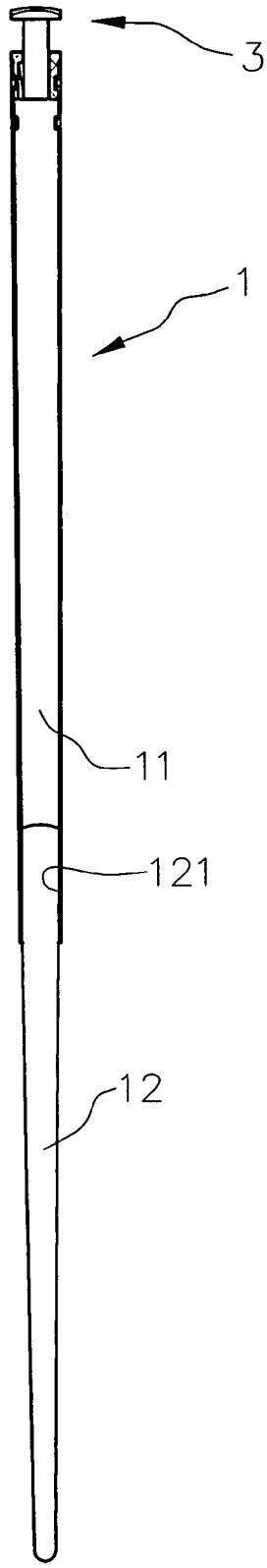
FIG. 5 shows the telescopic chopstick of the present invention in an extended state.

In use, as shown in FIGS. 4 and 5, the stop section 323 of the stem 322 is slidably inlaid in the slide channel 314 of the pocket 31. When the press button 32 is pressed down, the stem 322 will force the lower half 12 to disengage from the first protuberances 113. In the instant that the pressing force exceeds the limit of the abutting force of the first protuberances 113, the lower half 12 instantaneously bounds out toward the bottom end of the upper half 11, whereby the coupling section 121 of the lower half 12 can be tightly fitted with the bottom end of the upper half 11 for normal use.

Moreover, the chopsticks are made of metal material and the upper half 11 and the lower half 12 are connected without using any connecting member. Therefore, the present invention has simple structure and can be easily held and stored. After used and washed, the chopsticks can be received in the receiving spaces 21, 22 of the jacket 2.

Figure 6:
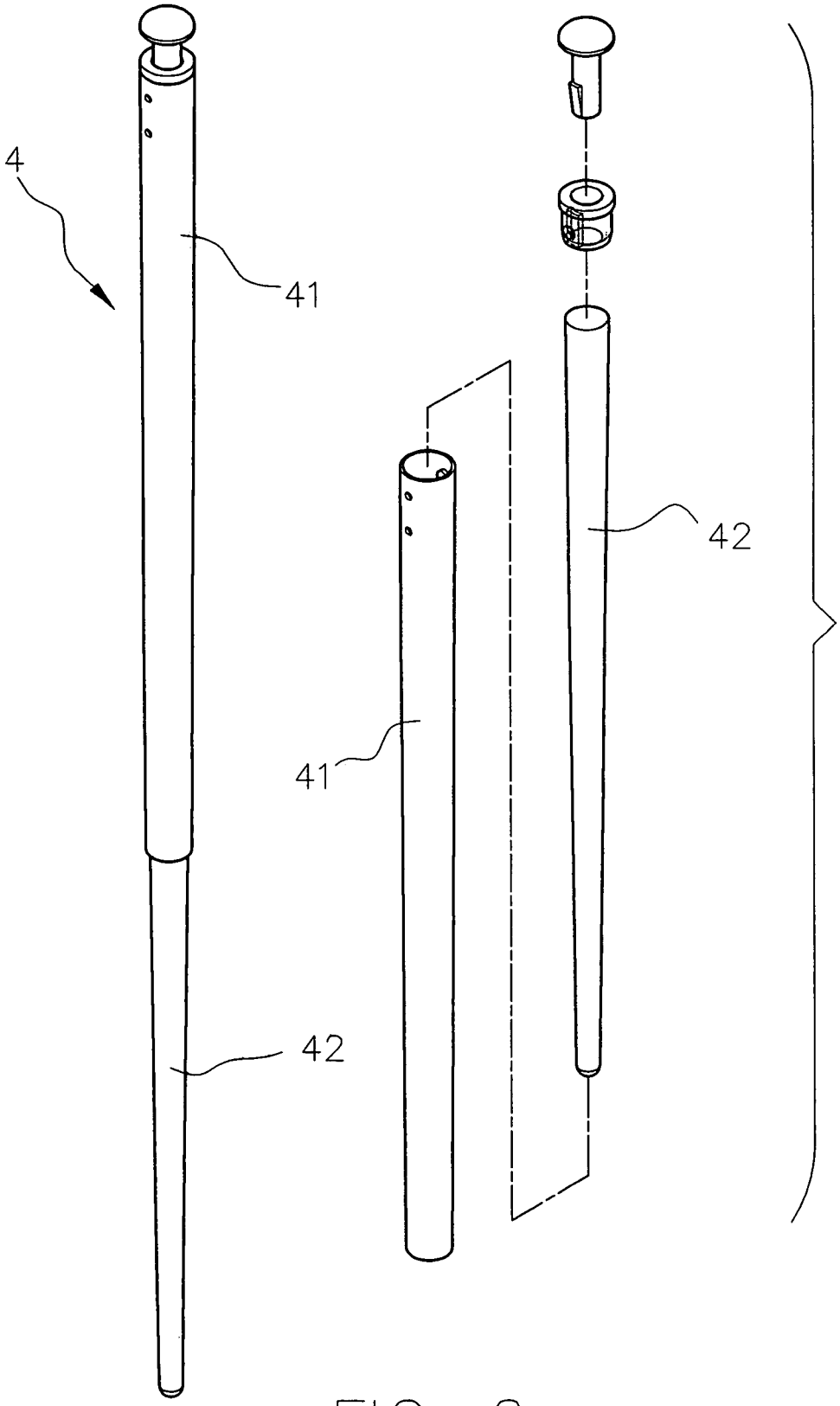
FIG. 6 is a perspective exploded view of a second embodiment of the telescopic chopstick set of the present invention.
Figure 7:
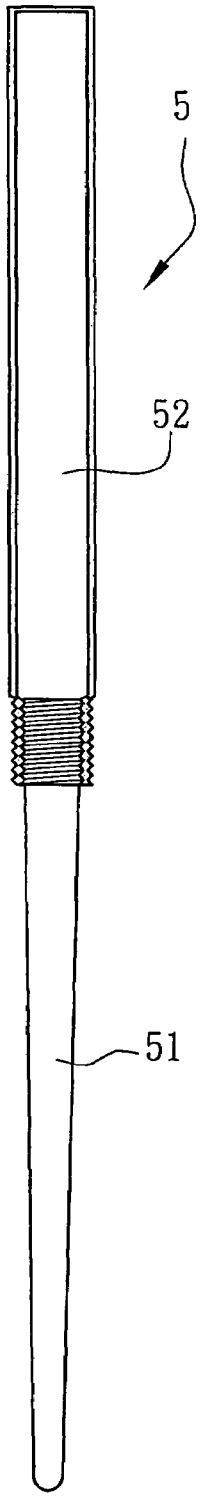
FIG. 7 PRIOR ART
FIG. 7 shows a conventional telescopic chopstick.
Figure 8:
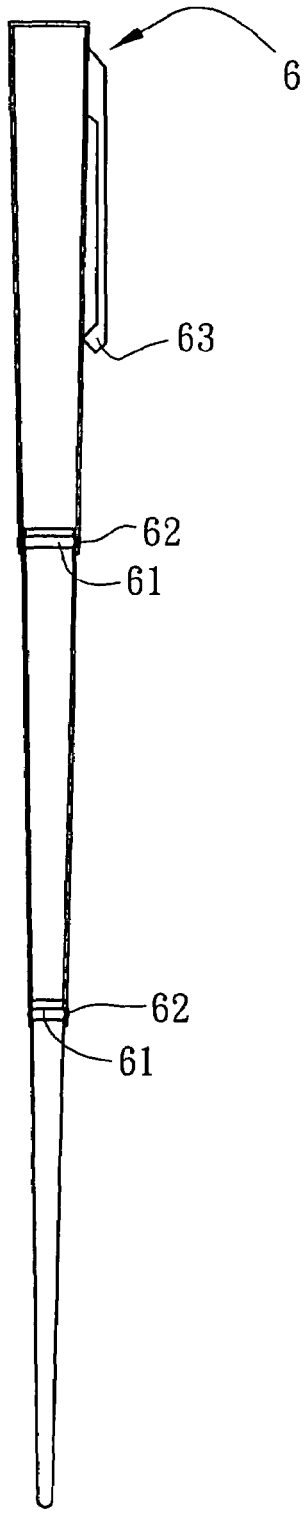
FIG. 8 PRIOR ART
FIG. 8 shows another conventional telescopic chopstick.

FIG. 6 shows a second embodiment of the present invention, in which the upper half 41 and lower half 42 of the chopstick 4 are substantially cylindrical bodies.

The above embodiments are only used to illustrate the present invention, not intended to limit the scope thereof. Many modifications of the above embodiments can be made without departing from the spirit of the present invention.

What is claimed is:

1. A telescopic chopstick set comprising a pair of chopsticks and a jacket for receiving the chopsticks, wherein each chopstick has an upper half and a lower half, the perimeters of two ends of the lower half being different from each other, an end of the lower half with a longer perimeter having a coupling section for fitting with a bottom end of the upper half, the upper half being a hollow member in which the lower half is accommodated, the upper end of the upper half having an upper opening, the lower end of the upper half having a lower opening, a press member being fitted in the upper opening of the upper half, a pair of opposite first protuberances and a pair of opposite second protuberances being formed on inner wall face of the upper half near the upper opening, whereby when the lower half is retracted into the upper half, the first protuberances abut against the coupling section of the lower half, the second protuberances serving to engage with and fix the press member with the upper half.

2. The telescopic chopstick set as claimed in claim 1, wherein the press member has a pocket and a press button, the press button having a press section and a stem extending from the press section, a stop section being formed on the stem, the pocket being fitted in the upper opening and having a chucking section and a fitting frame, the chucking section having a pair of transverse locating holes opposite to each other, a slide channel being formed on inner wall face of the chucking section, the slide channel having a lower opening, the stop section of the stem being slidably inlaid in the slide channel.

3. The telescopic chopstick set as claimed in claim 1, wherein an end of the lower half with a shorter perimeter can be fitted into the upper opening of the upper half, an inner perimeter of the lower opening being shorter than the perimeter of the coupling section of the lower half, whereby the coupling section of the lower half can be tightly fitted in the bottom end of the upper half.

* * * * *